United States Patent [19]

Wehl

[11] 4,395,694

[45] Jul. 26, 1983

[54] THERMOSTAT CONSTRUCTION EMPLOYING ARAMIDE INSULATION

[75] Inventor: Glenn E. Wehl, North Canton, Ohio

[73] Assignee: Portage Electric Products, Inc., North Canton, Ohio

[21] Appl. No.: 391,128

[22] Filed: Jun. 23, 1982

[51] Int. Cl.[3] ..... H01H 71/02

[52] U.S. Cl. ..... 337/112; 337/380

[58] Field of Search ..... 337/97, 112, 113, 380, 337/381

[56] References Cited

U.S. PATENT DOCUMENTS 3,825,868 7/1974 Jess et al. ..... 337/112

4,033,029 7/1977 Wolfe ..... 337/112 X

*Primary Examiner*—George Harris

*Attorney, Agent, or Firm*—McAulay, Fields, Fisher, Goldstein & Nissen

[57] ABSTRACT

A standard thermostatic switch, particularly one enclosed within a metallic casing, is provided with an insulating material, in the form of a sleeve, between the contacts or bimetallic elements and the metallic casing of the thermostat to aid in sealing the internal elements. The material is an aramide, particularly a copolymer of metaphenylenediamine and isophthaloyl chloride, particularly one marketed under the trademark "Nomex" by E. I. duPont deNemours & Co.

4 Claims, 4 Drawing Figures

THERMOSTAT CONSTRUCTION EMPLOYING ARAMIDE INSULATION

BACKGROUND OF THE INVENTION

Thermostat constructions are well known in the art. For example, such constructions are shown in U.S. Pat. No. 2,497,397, Dales, issued Feb. 14, 1950 and U.S. Pat. No. 3,100,247, Dales, issued Aug. 6, 1963. Each of these patents, as many of the others in the field, describes a thermostatic construction involving one or more bimetallic arms enclosed within a metallic casing. At least two contacts are provided, the contacts being joined when a bimetallic arm is in one position, and being separated, to break the contact, when a bimetallic arm is in the opposite position.

The constructions shown in the referenced U.S. Pat. Nos. 2,497,397 and 3,100,247 are not meant to be limiting, but merely illustrative of thermostat constructions employing bimetallic spring arms within a metallic casing. In these constructions, an insulating material is necessary between the casing and the point at which the contact arm, or a connector member attached to that contact arm, passes through the end of the casing. Among other things, the insulating member, or sleeve, is meant to prevent the free passage of air to and from the operating portion of the thermostat within the casing.

As shown in the two referenced patents, braided fiberglass is a frequently used insulating material in these constructions. Similarly, as referred to in the '397 patent, mica is often used as an insulating material. However, this fiberglass insulation, though widely employed in these constructions, presents several problems.

For example, the fiberglass is not dimensionally stable, and will expand as the ambient temperatures surrounding the thermostatic element increases. Further, in order to obtain sufficient dielectric strength in the fiberglass member, it must generally be impregnated. Continued operation of the thermostatic element, particularly in high temperature environments, tends to cause the material used for impregnation to migrate from the fiberglass member to the operating components of the thermostat. This contaminates the operating parts of the thermostat, impairing its accuracy and, frequently, causing premature wear of the parts. While the mica is frequently employed to lessen the problem caused by the low degree of imperviousness of the fiberglass, it does not completely solve the problem, as the fiberglass must still be used.

One method for avoiding the problems caused by fiberglass and/or mica has been to replace the fiberglass and mica with a polyimide film, such as that sold by E. I. duPont deNemours & Co. under the trademark "Kapton." This is not an entirely effective solution, either, however. The material is generally placed between the metallic casing and the contact strips in the form of a tube. Because Kapton cannot be formed with a sufficient thickness, multiple concentric tubes are generally employed. Because these are difficult to automatically index, thermostatic devices with Kapton insulation cannot generally be formed by the most expeditious method of manufacture, automatic assembly machines.

While the standard nylons have many of the characteristics desirable for a thermostatic device insulation, they, cannot be used as they will not withstand the high temperature environments in which such thermostatic devices are normally placed. While aromatic polyimides have been employed for their dielectric strength as shown, for example, in U.S. Pat. No. 4,259,544, Litauer, they have not been employed in thermostats, nor in the type of environment in which thermostats are called upon to operate.

BRIEF DESCRIPTION OF THE INVENTION

In accordance with the present invention it has unexpectedly been discovered that a thermostatic device, particularly one employing at least one bimetallic spring arm within a metallic casing can be formed and operated in high temperature environments without danger of contamination of the operating parts from the insulation material employed, when the insulation employed is a copolymer of meta-phenylenediamine and isophthaloyl chloride. In particular, a thermostatic device formed with insulation of this type can be safely operated at temperatures over 200° C. This is particularly important as the primary uses of these thermostats are, for example, in the control of the heating coil operation in electric blankets, in controlling of electrical appliances, and in the protection of motors and lighting devices operated at high temperatures.

A particular example of the insulation described as a copolymer of meta-phenylenediamine and isophthaloyl chloride is that sold under the trademark "Nomex" by E. I. duPont deNemours & Co. The material retains much of its strength, even at the high temperature referred to, has good dielectric strength and volume resistivity, and has a low dissipation factor.

Because thickness is not a problem, as referred to previously for Kapton, the Nomex can be formed for use in the thermostat construction as a single sleeve, and this is the preferable manner of employing it. With the single sleeve, it is possible to form the thermostatic devices on automatic equipment, thus resulting in substantial cost savings, in addition to the operating advantages obtained by the use of the Nomex material. The aramide material described, while more expensive than fiberglass, results in fewer rejects on formation of the thermostatic device, so that the additional material cost is not a factor.

DESCRIPTION OF THE PREFERRED EMBODIMENTS

Figure 1:
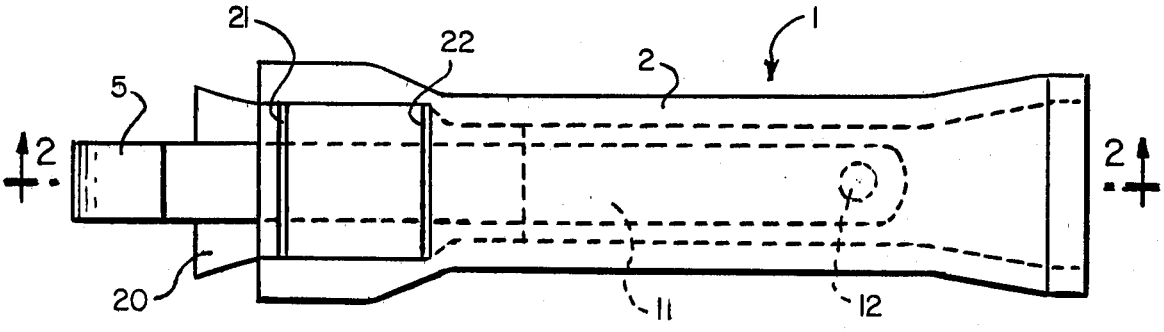
FIG. 1 is a plan view, partially in section, of a live-case thermostat employing the insulation of the present invention.

The invention is directed to the use of a copolymer of meta-phenylenediamine and isophthaloyl chloride as an insulation for a thermostat. As should be apparent, the particular type of thermostat to which this insulation is applied is not a critical factor; e.g., the thermostat case can be conducting or nonconducting. Since the insulation of the present invention is always employed to separate an electrically conductive member from another member of the thermostat construction, the particular material of construction of the thermostat case is not critical. Accordingly, the thermostat construction of the present invention can be those known in the industry as a live-case thermostat or a dead-case thermostat, indicating that the thermostat casing does or does not conduct electricity. Accordingly, in accordance with the present invention, two embodiments of the present invention are illustrated in the drawings, FIGS. 1 through 3 relating to a live-case, or electrically conductive case, thermostat, while FIG. 4 shows a dead-case thermostat, or one where the casing of the thermostat is an electrical insulator.

Figure 2:
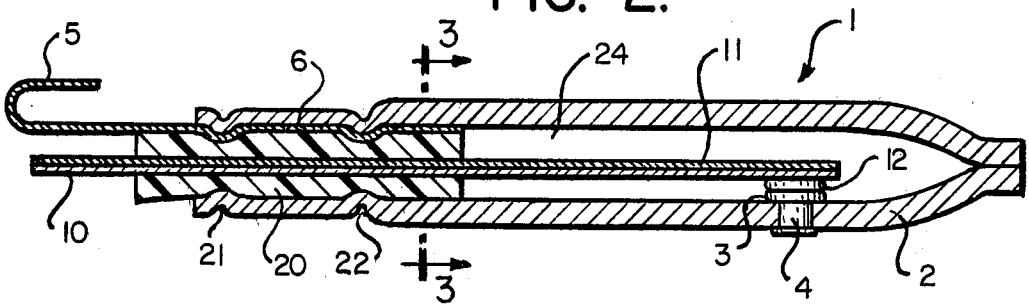
FIG. 2 is a section along the line 2—2 of FIG. 1.
Figure 3:
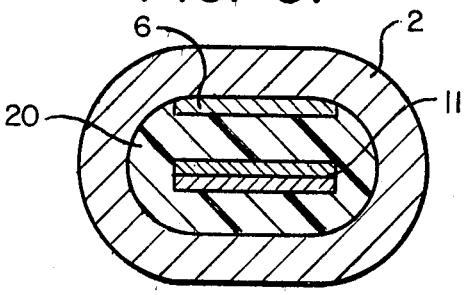
FIG. 3 is a section along the line 3—3 of FIG. 2.
Figure 4:
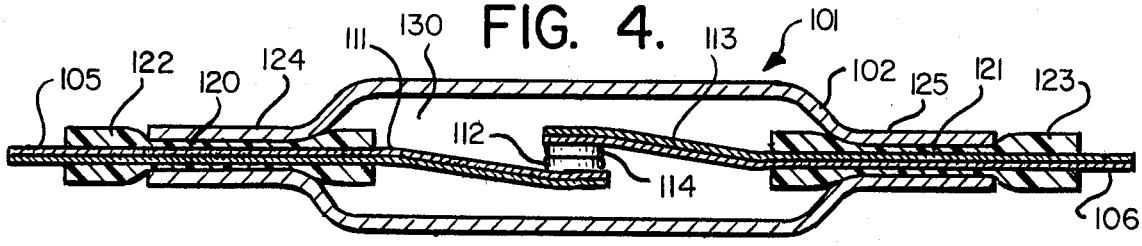
FIG. 4 is a view, similar to FIG. 2, of an insulated case thermostat employing the insulation of the present invention.

Referring to the drawings, and particularly FIGS. 1 through 3, a thermostatic device 1 is illustrated having a metallic case 2. Mounted to the wall of the metallic casing 2 is an electrical contact 3, as by means of rivet 4. Electrical contact of the metallic casing 2 with an external circuit (not shown) is accomplished by means of a connector 5. The connector 5 includes a portion 6 which is in contact with the casing 2.

The thermostatic device 1 also includes a bimetal arm 10 constructed in known fashion. The bimetallic arm 10 includes an extension portion 11 which carries a movable contact 12. When the circuit is completed, the movable contact 12 mates with the stationary contact 3 to complete the electrical circuit, as particularly illustrated in FIG. 2.

The device illustrated in FIGS. 1 through 3 is one wherein the electrical circuit is completed when the thermostatic device 1 is below a critical temperature. This would be the type of environment experienced, for example, in an electric blanket construction. Obviously, when the environmental temperature exceeds a preselected point, the thermostatic arm 11 moves upwardly, separating movable contact 12 from stationary contact 3.

In order to electrically insulate the thermostat 10 from the conductive casing 2, an insulating sleeve 20 is provided. This sleeve 20 is the subject of the present invention and prevents electrical connection between bimetal 10 and casing 2. In assembling the device, if desired, crimps 21 and 22 may be formed in the casing to aid in mechanically locking the various pieces together. As will be seen, this is an aid in holding portions 6 of connector 5, the bimetal 10, and insulator 20, in a prearranged position within casing 2. Further, the crimps aid in preventing entry of air or contaminating gases into the space 24 which is left within the casing 2.

In accordance with the present invention, the sleeve 20 is formed of an aramide. A particularly suitable aramide is a copolymer of meta-phenylenediamine and isophthaloyl chloride, particularly that sold under the trademark "Nomex" by E. I. duPont deNemours & Co. When employed in a construction of the type illustrated in the present invention, this aramide sleeve provides the necessary insulation between the various electrically conductive parts of the device and, at the same time, acts to prevent the passage of air into the interior of the metallic casing 2. The thermostatic device 1 illustrated can easily be formed and assembled in automatic machinery because of the use of the aramide sleeve 20. Further, because the aramide sleeve does not give off vapors under high temperature, the operating life of the thermostatic device 1 is improved because of the avoidance of corrosion and coating of the contact members 3 and 12.

As indicated, the use of the aramide sleeve in accordance with the present invention is not limited to a live-case thermostat. Such a sleeve may also be employed when the thermostatic device incorporates a non-conductive sleeve. This embodiment of the device is particularly illustrated in FIG. 4 where a thermostatic device 101 includes an insulating casing 102 having two connectors 105 and 106. As illustrated in FIG. 4, each of these connectors is a bimetal. If desired, only one of the connectors need be a bimetal, the other being formed of a standard, spring material. Lead 105 is integral with extension 111, the extension carrying a first contact 112. Lead 106 is integral with a second extension 113, this extension carrying contact 114. When the electrical circuit is to be completed, based upon the temperature to which the thermostatic device 101 is subjected, contacts 112 and 114 are in engagement. When the temperature to which the thermostatic device 101 is subjected causes the contacts to separate, because of a bending of the bimetal elements, or only one of the bimetal elements if only one is employed, contacts 112 and 114 separate to disconnect the electrical circuit.

As in the first embodiment of the invention, insulation between the leads and the thermostat casing are provided by aramide sleeves, lead 105 being separated from casing 102 by sleeve 120, and lead 106 being separated from casing 102 by insulating sleeve 121. As illustrated, the sleeve members 120 and 121 have extensions 122 and 123 which cover a portion of the lead extending beyond the casing. Such extensions are not necessary, though desirable. If desired, the portions 124 and 125 of the casing 102 which surround the sleeves 120 and 121 may be crimped both to aid in locating the parts mechanically and to further prevent leakage of air or other gases into the space 130 left within the thermostat casing.

The aramide sleeves 120 and 121 of the thermostatic device 101 are formed of the same materials as the sleeve 20 of the first embodiment of the present invention.

While specific embodiments have been shown and described, the invention should not be considered as limited to these specific examples, but only as limited by the appended claims.

I claim:

1. In a thermostatic device comprising a casing, at least one bimetallic element, a contact associated with that bimetallic element, a second contact within the casing for mating with said first contact in order to complete an electric circuit, means for electrically connecting said bimetallic element to an external circuit and means for connecting said second contact to an external electrical circuit, the improvement which comprises the use of an aramide insulating sleeve in an open end of said casing to electrically insulate said bimetallic element and associated electrically conductive parts from other parts of said thermostatic device.

2. The device of claim 1 wherein said aramide is a copolymer of meta-phenylenediamine and isophthaloyl chloride.

3. The thermostatic device of claim 1 wherein said casing is a live-case casing.

4. The thermostatic device of claim 1 wherein said casing is a dead-case casing.

* * * * *